United States Patent [19]

Kling

[11] 4,450,756

[45] May 29, 1984

[54] FUME EXHAUSTER DEVICE

[76] Inventor: Miguel Kling, Seestrasse 38, D-8131 Berg, Fed. Rep. of Germany

[21] Appl. No.: 336,934

[22] Filed: Jan. 4, 1982

Related U.S. Application Data

[63] Continuation of Ser. No. 070,055, Aug. 27, 1979, abandoned.

[30] Foreign Application Priority Data

Aug. 28, 1978 [DE] Fed. Rep. of Germany ..... 2837543

[51] Int. Cl.[3] ..... F24F 9/00

[52] U.S. Cl. ..... 98/115 R; 55/400; 55/413; 55/467; 55/DIG. 36; 126/299 D; 98/36

[58] Field of Search ..... 55/DIG. 29, DIG. 36, 55/400, 413, 467, 471; 98/36, 115 R, 115 LH; 126/299 R, 299 D

[56] References Cited

U.S. PATENT DOCUMENTS

| | | | |
|---|---|---|---|
| 1,799,144 | 4/1931 | Balusek | 98/36 X |
| 2,210,458 | 8/1940 | Keilholtz | 55/DIG. 29 |
| 3,023,688 | 3/1962 | Kramer, Jr. | 98/36 |

FOREIGN PATENT DOCUMENTS

| | | | |
|---|---|---|---|
| 1912186 | 10/1964 | Fed. Rep. of Germany . | |
| 1234966 | 2/1967 | Fed. Rep. of Germany | 98/36 |
| 1679545 | 3/1967 | Fed. Rep. of Germany . | |
| 1604293 | 9/1970 | Fed. Rep. of Germany . | |
| 2208317 | 6/1974 | France . | |
| 2279484 | 2/1976 | France | 126/299 D |
| 1275569 | 5/1972 | United Kingdom . | |
| 1400224 | 7/1975 | United Kingdom . | |
| 467211 | 8/1975 | U.S.S.R. | 98/36 |

*Primary Examiner*—Edward G. Favors
*Assistant Examiner*—Harold Joyce
*Attorney, Agent, or Firm*—Stevens, Davis, Miller & Mosher

[57] ABSTRACT

A fume exhauster device comprising first means for generating a first air current directed substantially axially toward the first means, and second means for generating a second air current concentrically surrounding the first air current and flowing in circumferential and axial directions away from the second means, the second means comprising a substantially annular exit opening defined at least along its outer periphery by a peripheral surface extending in axial direction for forming the second air current into a cylinder shroud the outer diameter of which is substantially equal to the outer diameter of the exit opening.

17 Claims, 15 Drawing Figures

Figure 1A:
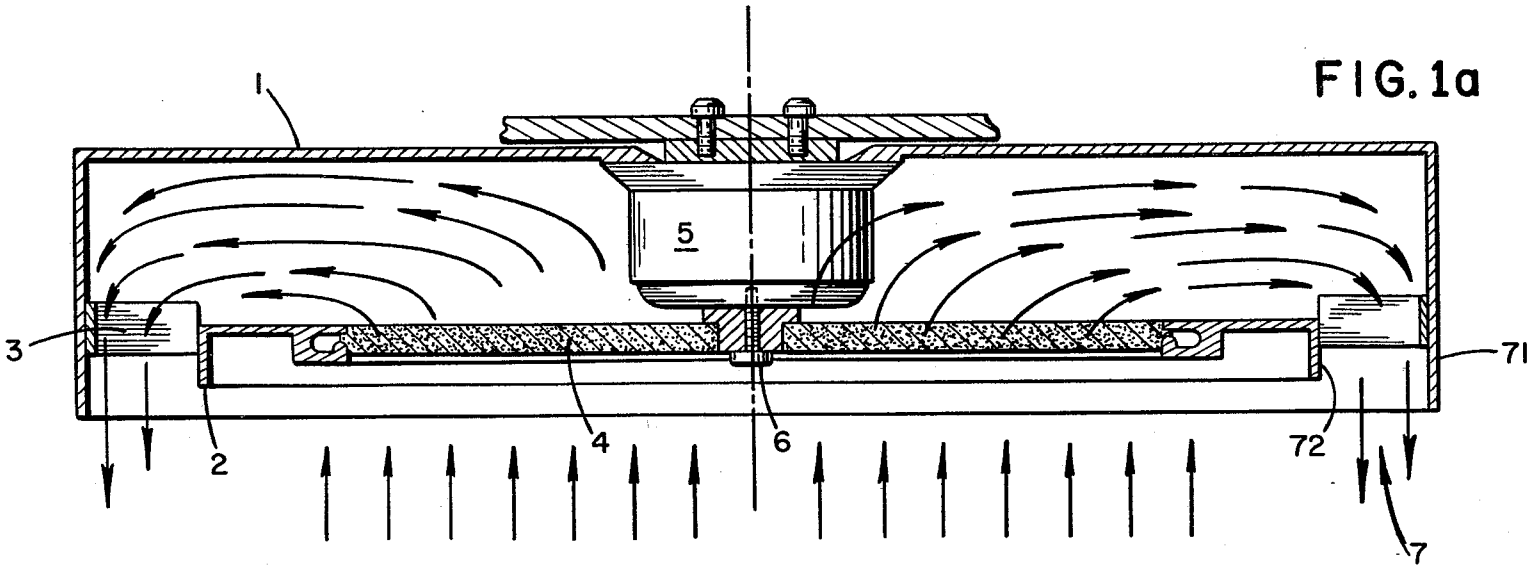

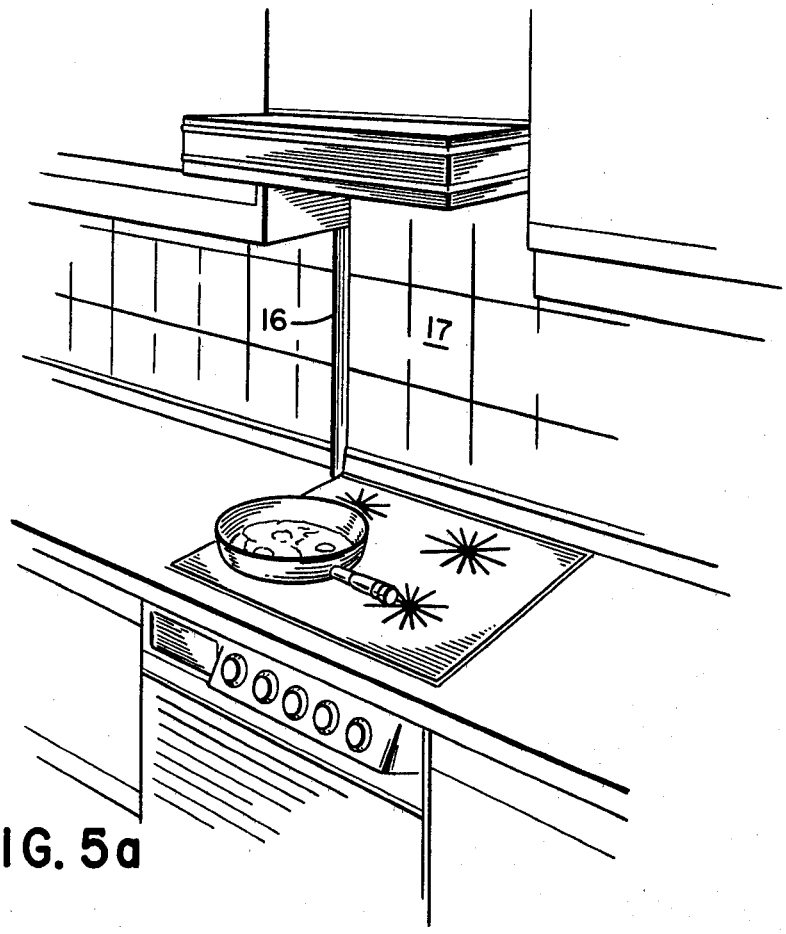
FIG. 5a
FIG. 5b
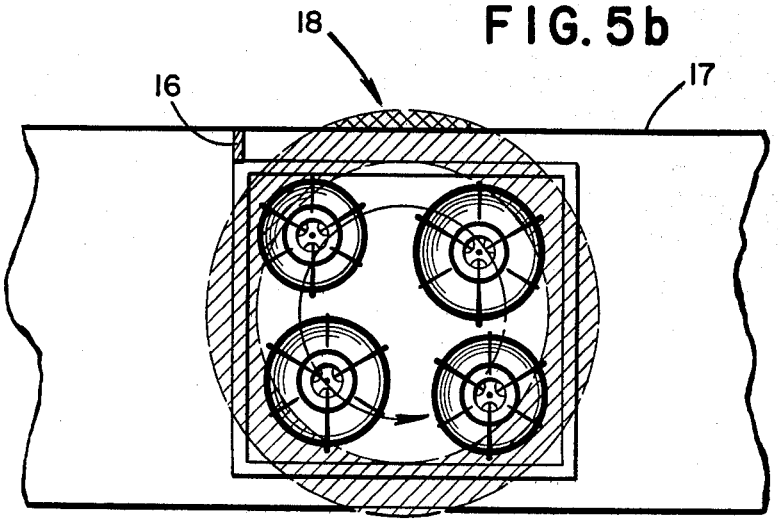

FUME EXHAUSTER DEVICE

This is a continuation of application Ser. No. 70,055 filed Aug. 27, 1979 now abandoned.

This invention relates to a fume exhauster device comprising first means for generating a first air current directed substantially axially towards said first means, and second means for generating a second air current concentrically surrounding said first air current and flowing in circumferential and axial directions away from said second means.

Known from DE-PS No. 1,289,974 is a fume exhauster device of the above captioned type for employ for instance with a kitchen stove for exhausting fumes and other volatile reaction products released during cooking and frying, said known device comprising a cylindrical swirl duct opening downwards in the direction of the fume source, and one or several jets located about the upper portion of said swirl duct and opening tangentially into the interior thereof at a downward inclined angle toward said fume source. The swirl duct and the jets, which in the known fume exhauster device act as said second means, serve to generate said second air current flowing downward in axial direction towards the fume source as well as in circumferential direction and surrounding a first air current in the form of an upward directed axial suction current. The upward directed first air current is formed, or generated, respectively, by the swirl duct and an exhaust duct connected to the upper end portion thereof and forming said first means therewith. Although the known fume exhauster device will, by means of said swirl duct and said jets, generate said second air current in the form of a curtain concentrically surrounding said first air current, the formation of this current is not achieved in practice, since the axial length of such curtain is determined by the angle of inclination of the jets within the swirl duct and depends of a corresponding lengthening of the swirl duct in axial direction. If, however, the axial length of the swirl duct is restricted to a predetermined magnitude, the jets will generate individual helical streams separated by open interstices through which the surrounding air may penetrate, deteriorating the vacuum required within the curtain for generating the first air current. An increase of the velocity of the air current generated by the jets does not either remedy this defect, since the inner and outer flow vortices within the swirl duct will move closer together with increasing flo velocities, whereby the inner current may be entrained by the outer current, so that the fume-laden air may again be ejected downward. In the known fume exhauster device, the formation of the second air current as a closed curtain is thus only possible with a swirl duct of sufficient length, the diameter of this curtain being even then only a fraction of the opening diameter of the swirl duct.

It is an object of the invention to improve a fume exhauster device of the type set forth in the introduction in such a manner that the second air current can be formed as a closed curtain of great axial length and great diameter without requiring a swirl duct of great length.

In a fume exhauster device of the above-defined type this object is attained according to the invention by providing that said second means comprises a substanially annular exit opening defined at least along its outer periphery by a peripheral surface extending in axial direction for forming said second air current into a cylindric shroud the outer diameter of which is substantially equal to the outer diameter of the exit opening.

In the fume exhauster device according to the invention, the second air current exits from an annular exit opening. At least the outer peripheral surface defining said exit opening extends over a determined length in the axial direction of the second air current in order to impart the form of a homogenous cylinder shroud to the second air current exiting from the exit opening and having flow components extending in the axial and circumferential directions. The inner boundary of the exit opening may also be formed by a circumferential surface extending in axial direction of the second air current, the relative lengths of the outer and inner boundary surfaces in this case determining an eventual divergence or convergence of the cylinder shroud. If the outer boundary surface is longer in the direction of flow of the second air current than the inner boundary surface, the resulting cylinder shroud will have a substantially constant diameter or may even be slightly convergent, while a greater length in the flow direction of the second air current of the inner boundary surface will result in a divergent cylinder shroud.

According to embodiments of the invention set forth in the sub-claims, the axial and circumferential flow components of the second air current may be created in various manners, such as by employing an axial impeller, a radial impeller rotor in combination with suitable flow guide means or even stationary baffles impinged on by a substantially axially directed air current.

Further embodiments of the invention are set forth in the sub-claims.

Figure 1B:
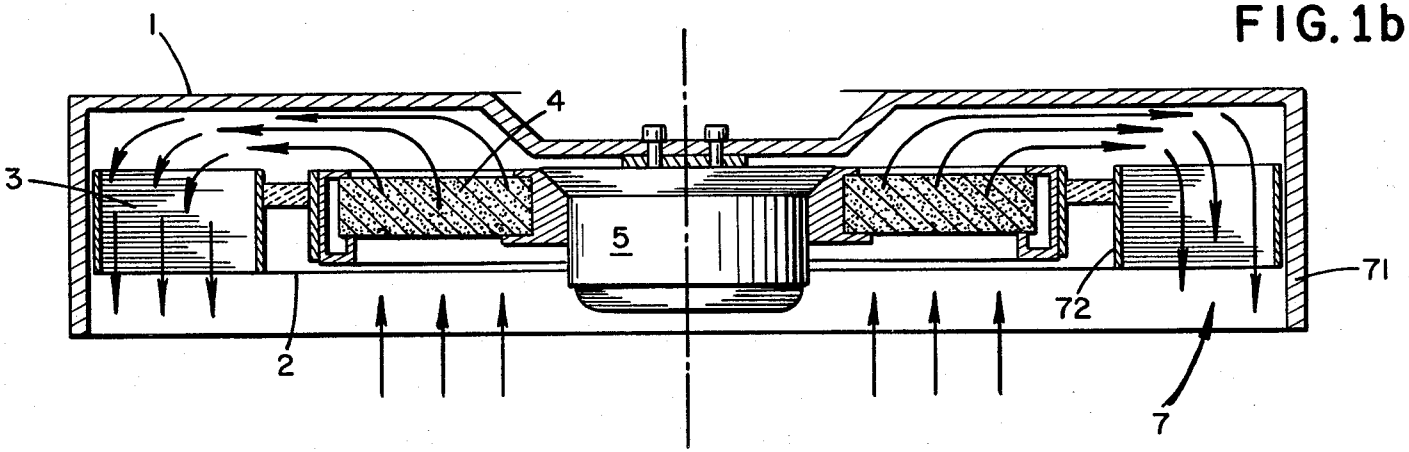
Figure 1C:
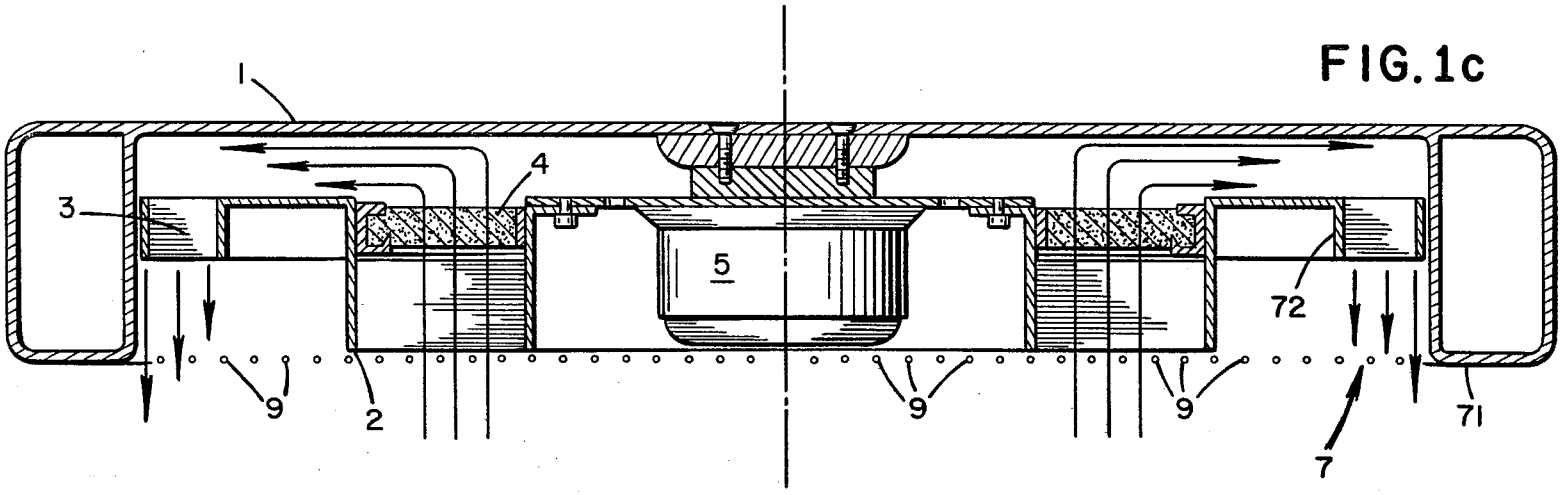
Figure 2A:
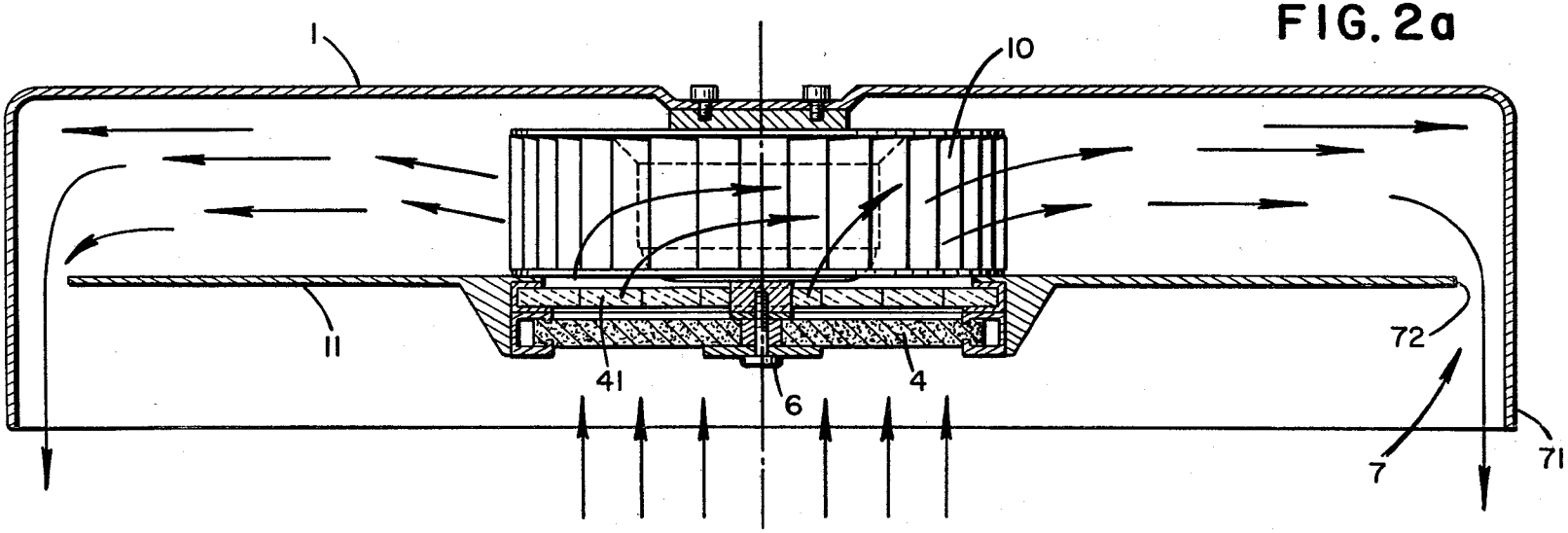
Figure 2B:
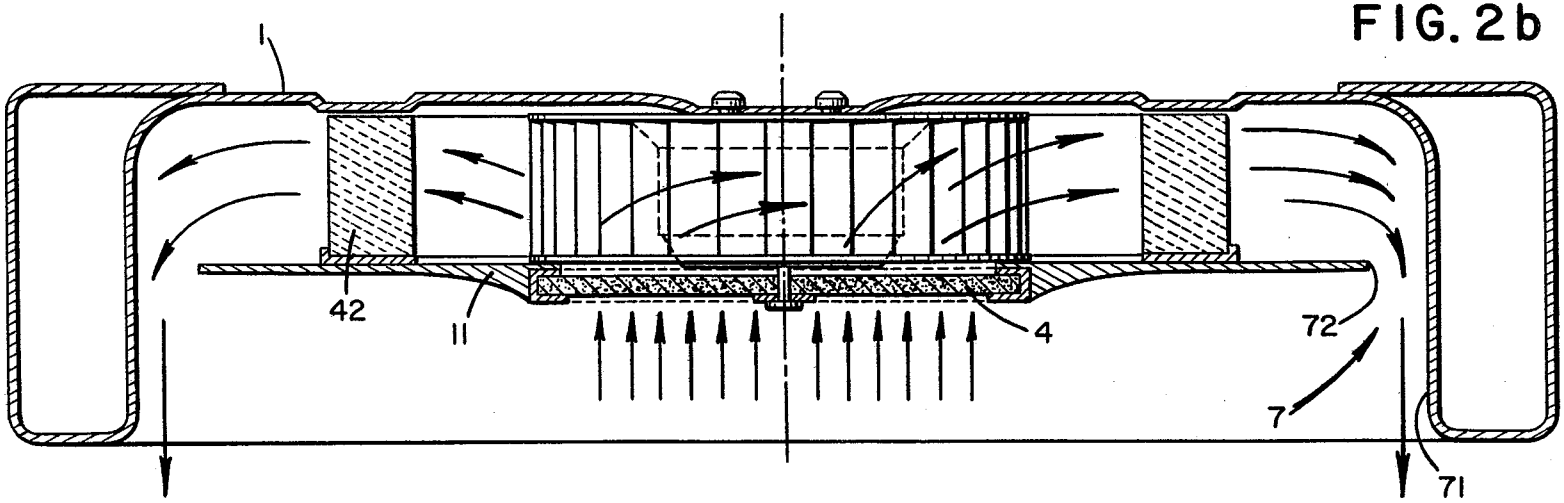
Figure 2C:
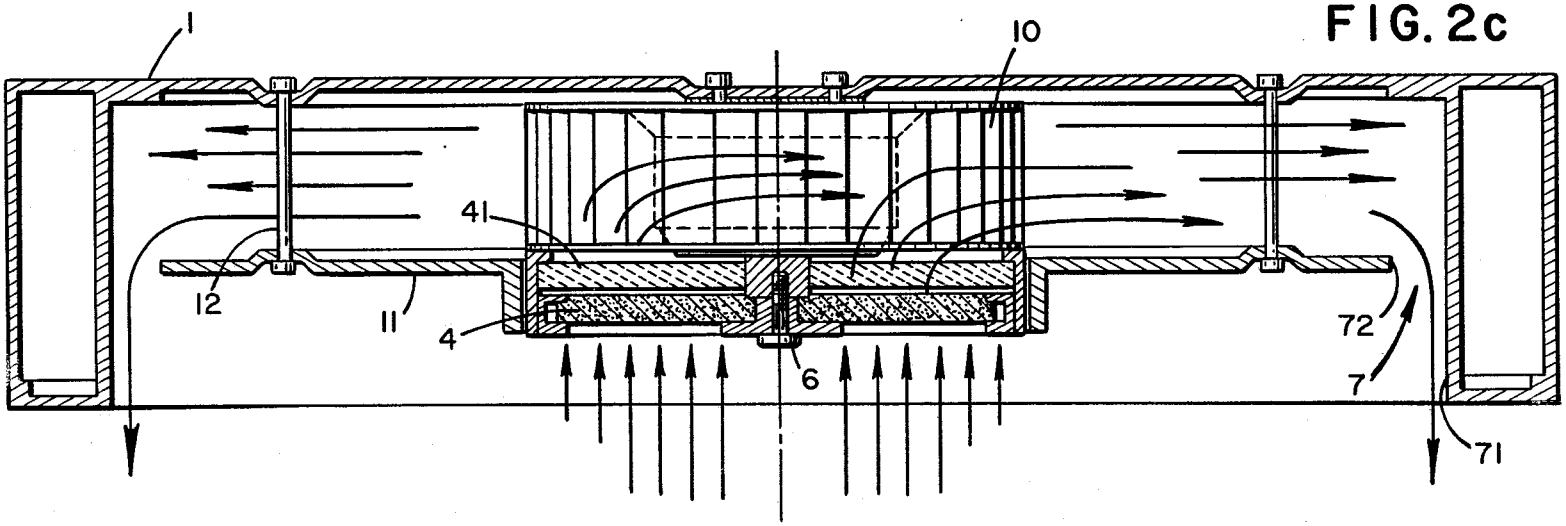
Figure 2D:
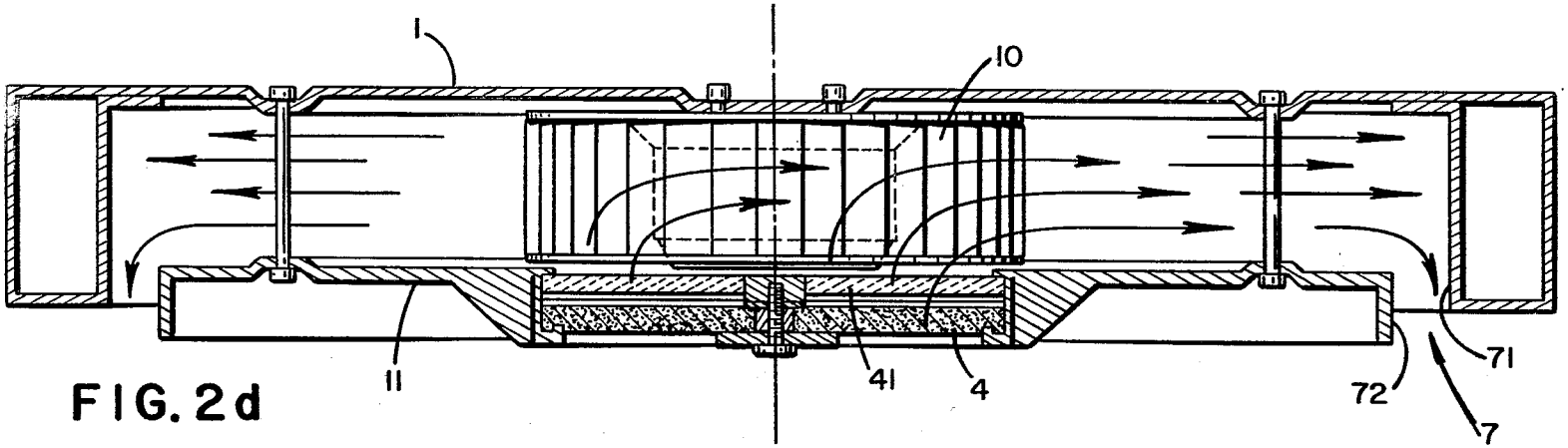
Figure 3:
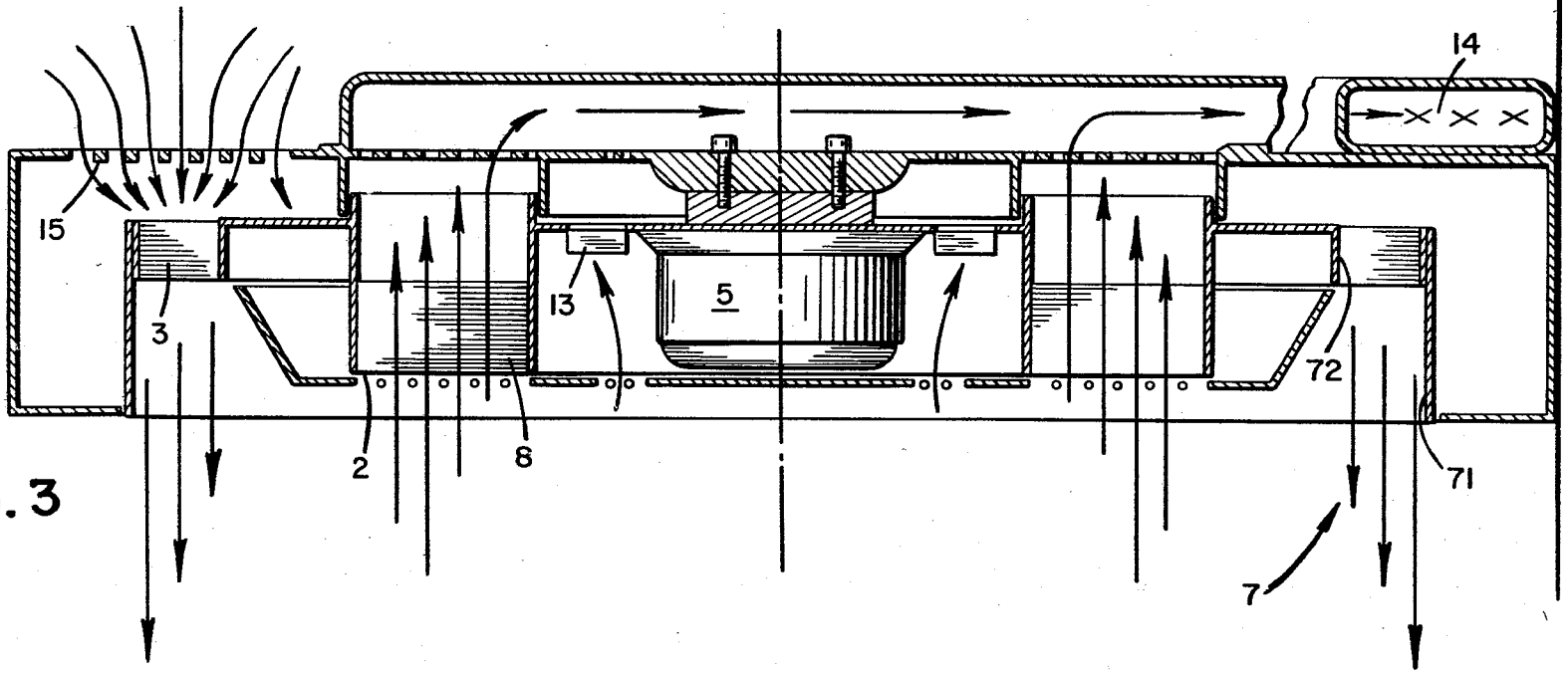
Figure 4:
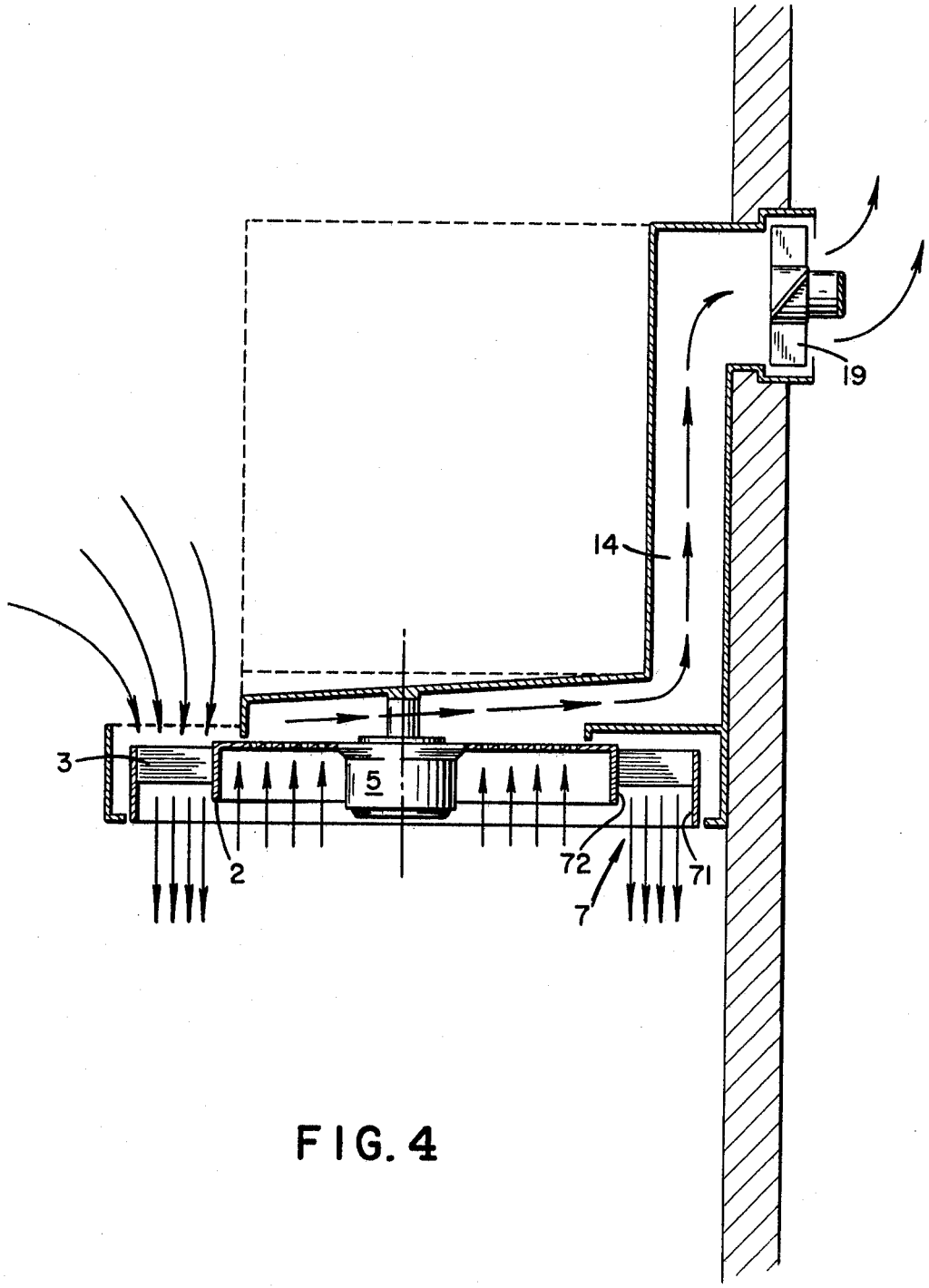
Figure 6A:
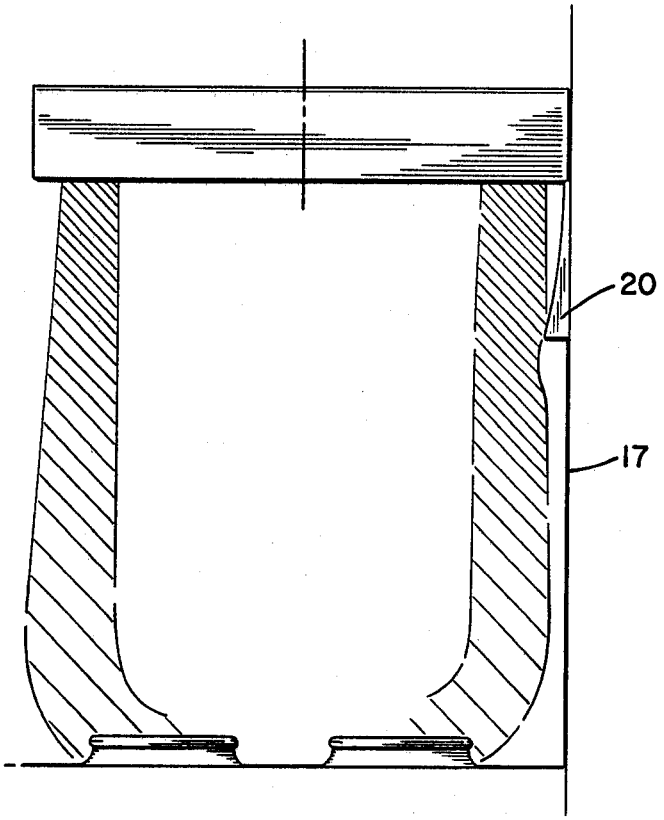
Figure 6B:
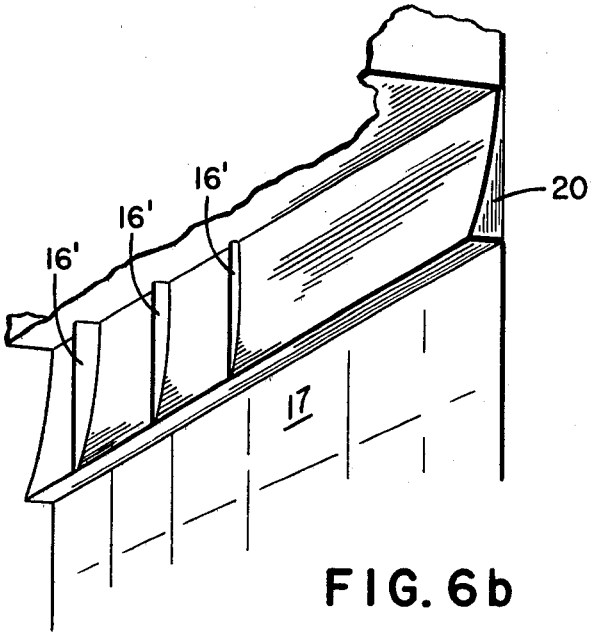
Figure 7A:
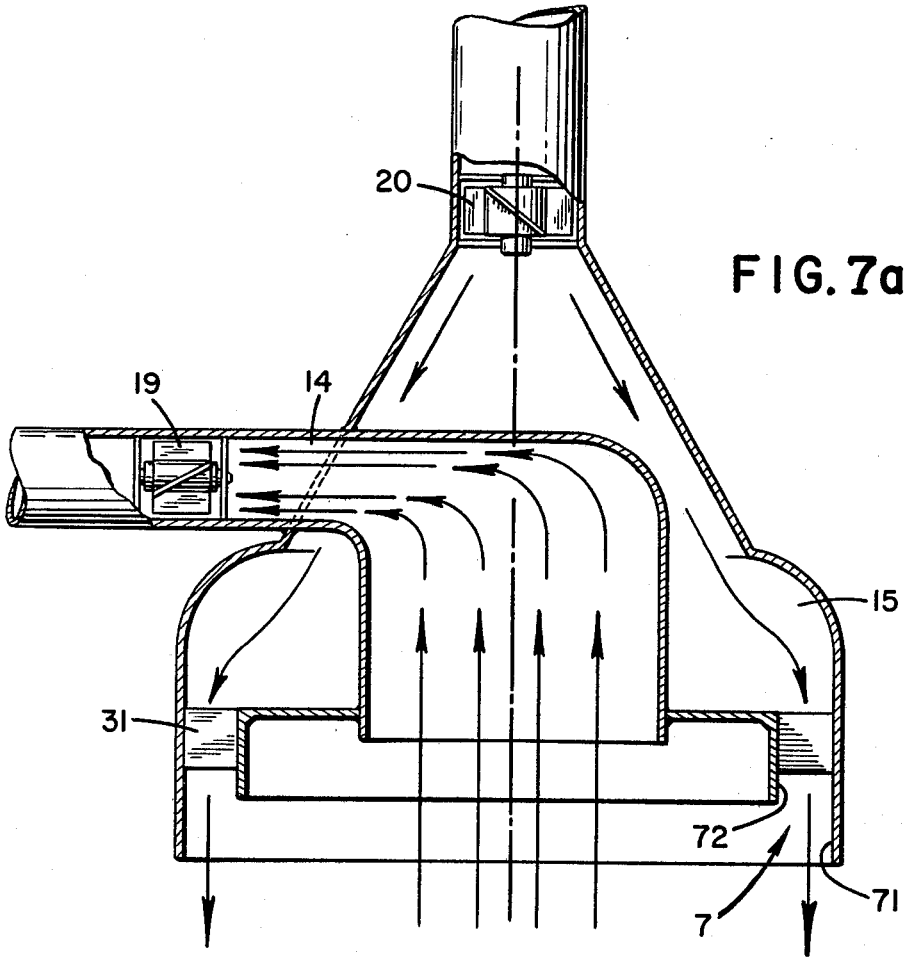
Figure 7B:
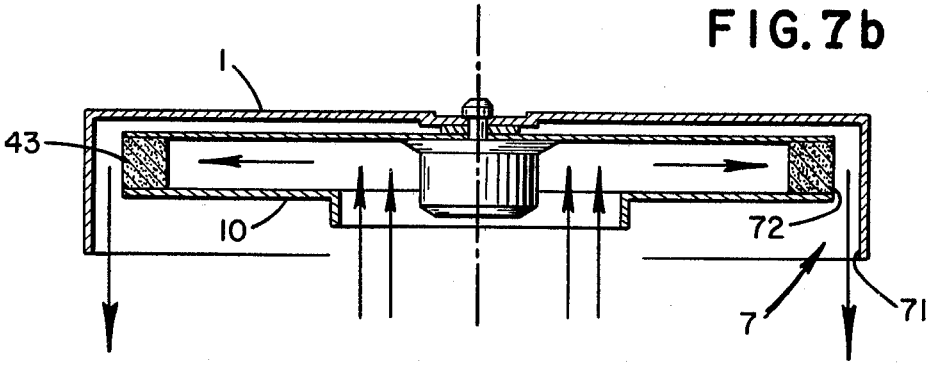

Exemplary embodiments of the invention shall now be described with reference to the drawings, wherein:

FIG. 1*a* shows a first embodiment having an axial impeller integral with a housing forming a flow guide means, FIG. 1*b* shows a second embodiment having an axial impeller and a stationary housing forming a flow guide means, FIG. 1*c* shows a third embodiment with an axial impeller having two impeller vane rings, and a stationary housing acting as a flow guide, FIG. 2*a* shows a fourth embodiment having a radial impeller rotor and a corotating disc contributing to guiding the air current, FIG. 2*b* shows a fifth embodiment having a radial impeller rotor and a corotating disc contributing to guiding the air current, FIG. 2*c* shows a sixth embodiment having a radial impeller rotor and a stationary disc contributing to guiding the air current, FIG. 2*d* shows a seventh embodiment having a radial impeller rotor and a stationary disc contributing to guiding the air current and formed with a inner peripheral surface extending beyond the outer peripheral surface of the exit opening in the flow direction of the second air current, FIG. 3 shows an eighth embodiment having an axial impeller with two impeller vane rings, an air current induction duct, and an air current exhaust duct, FIG. 4 shows an embodiment similar to that of FIG. 3 including in addition a suction blower in the air current exhaust duct, FIG. 5*a* and 5*b* show a first arrangement of a baffle for eliminating the effect of a wall interfering with the cylinder shroud-shaped second air current, FIG. 6*a* and 6*b* show a second arrangement of a baffle for eliminating the effect of a wall interfering with the cylinder shroud-shaped second air current, FIG. 7*a* shows a ninth embodiment with stationary flow guide baffles disposed in the exit opening, and FIG. 7*b* shows a tenth embodiment having a radial impeller rotor the outer peripheral surface of which forms the inner boundary surface of the exit opening.

In the first embodiment of the fume exhauster device shown in FIG. 1*a*, the first and second means are formed by a housing 1 integrally connected to an axial impeller 2 having a first ring of impeller vanes 3 extending in substantially radial direction in an exit opening 7, said opening being defined by an outer and an inner peripheral surface 71 and 72, respectively. In the direction of flow of the second air current, outer peripheral surface 71 extends beyond inner peripheral surface 72, whereby the second air current is formed into a cylinder shroud of substantially constant diameter or into a slightly converging cylinder shroud. The center portion of axial impeller 2 has a through-opening and is provided with a filter 4 releasably affixed to the drive shaft of an impeller motor 5 by means of a single center bolt 6.

As clearly evident from the drawing, the first air current enters housing 1 in axial direction through filter 4, is deflected within the housing and is then accelerated by the impeller vanes 3 in exit opening 7 to exit downward therefrom in axial direction as the second air current. Due to the rotation of axial impeller 2, the second air current has a downward-directed axial flow component as well as a circumferential flow component. The intake side of axial impeller 2 thus forms the first means, while the second means is generally formed by the outlet side of impeller 2 in combination with exit opening 7. Impeller motor 5 is stationary, while housing 1 is integral with impeller 2 for rotation therewith and with the drive shaft of motor 5.

The second embodiment of the fume exhauster device shown in FIG. 1*b* differs from the embodiment shown in FIG. 1*a* mainly by the housing 1 being stationary, so that the axial impeller rotates relative thereto. While the outer peripheral surface 71 defining the exit opening 7 is again formed by the inner peripheral surface of housing 1, the inner peripheral surface 72 of exit opening 7 is formed by the inner peripheral surface of the impeller vane ring 3. Filter 4 is formed here as a filter ring concentrically surrounding impeller motor 5. Operation of this second embodiment is substantially identical with that of the first embodiment.

In the third embodiment of the fume exhauster device shown in FIG. 1*c*, axial impeller 2 is provided with two impeller vane rings 3 and 8, the vanes of which are oriented at opposite attitudes to one another. The first ring of vanes 3 of axial impeller 2 again generates the second air current, creating an axially downwardly and a circumferentially directed flow component therein. The second ring of impeller vanes 8 on the other hand generates the first air current having only a substantially axial upwardly directed flow component. Housing 1 is again stationary, and its inner peripheral surface forms the outer boundary surface 71 of exit opening 7. The inner boundary surface 72 of exit opening 7 is again formed by the inner peripheral surface of first impeller vane ring 3. The third embodiment additionally includes a protective grid 9 formed of concentric rings for minimizing eddy-current losses. The annular filter 4 is located downstream of the second impeller vanes 8 and rotates in unison with axial impeller 2.

In the fourth embodiment of the fume exhauster device shown in FIG. 2*a*, the axial impeller employed in the preceding embodiments is replaced by a radial impeller rotor 10 acting as said first means for generating the axially upwardly directed first air current at its intake side. At its downstream side, impeller 10 generates a substantially radial and circumferential air current, which by means of a flow guide formed by housing 1 is deflected downwards in the direction of exit opening 7, exiting therefrom as the second air current again having axially downwardly and circumferentially directed flow components. The air current is additionally guided by a disc-shaped plate 11 rigidly attached to radial impeller rotor 10 for rotation therewith. The center portion of plate 11 has a through-opening for ingress of the first air current and for receiving filter 4 and an additional charcoal filter disc 41. Filters 4 and 41 are again releasably fastened by means of a single center bolt 6, so that they may be readily replaced. The outer boundary surface 71 of exit opening 7 is again formed by the inner peripheral surface of stationary housing 1, while the inner boundary 42 of exit opening 7 is formed by the edge of disc-shaped plate 11.

FIG. 2*b* shows an embodiment of the fume exhauster device similar to the one shown in FIG. 2*a* and also comprising a radial impeller rotor 10. In contrast to the preceding embodiment, the device shown in FIG. 2*b* includes an additional filter 42 rotating in unison with the disc-shaped plate 11 and the impeller 10 and being in the form of a filter ring for passage therethrough of the air current accelerated by impeller 10 in radial direction. Otherwise the operation of this embodiment substantially corresponds to that of the embodiment shown in FIG. 2*a*.

The sixth embodiment shown in FIG. 2*c* likewise comprises a radial impeller rotor 10. In this embodiment, however, the disc-shaped plate 11 is stationary and connected to stationary housing 1 by means of bolts 12. Plate 11 again has a center opening for receiving filter 4 and an additional charcoal filter 41 connected to impeller 10 for rotation in unison therewith. Filters 4, 41 are again releasably attached to impeller 10 by means of a single center bolt 6. The remainder of this embodiment as well as its operation again correspond to those of the preceding embodiments and need therefore not be described in detail.

The seventh embodiment of the fume exhauster device shown in FIG. 2*d* corresponds to the one shown in FIG. 2*c*, with the difference, however, that the stationary disc-shaped plate 11 has a cylindrical peripheral surface extending downward in the axial direction of the second air current and forming the inner boundary surface 72 of exit opening 7. As readily evident from the drawing, the inner boundary surface 72 of exit opening 7 in this embodiment is of greater length in the direction of the second air current than the outer boundary surface 71, whereby to achieve a divergence of the homogenous cylinder shroud shape of the second air current.

In the eighth embodiment of the fume exhauster device shown in FIG. 3, there is again provided an axial impeller 2 having a first ring of impeller vanes 3 and a second ring of impeller vanes 8, so that this embodiment corresponds to the one shown in FIG. 1*c*. Axial impeller 2 additionally includes further impeller vanes 13 located adjacent impeller motor 5 for the cooling thereof. Further in the embodiment shown in FIG. 3, the first air current generated by means of the second ring of impeller vanes 8 is exhausted to the atmosphere via an exhaust duct 14, while the second air current generated by the first ring of impeller vanes 3 is formed of fresh air or interior air supplied via an air supply duct 15. The outer boundary surface 71 of exit opening 7 in this embodiment is formed by the outer peripheral wall of axial impeller 2, while the inner boundary surface, which in the shown embodiment is shorter in the direction of the second air current, is formed by the inner wall of the first ring of impeller vanes 3 of axial impeller 2. Also in this embodiment, the first ring of impeller vanes 3 generates an axially and circumferentially downwardly directed second air current forming a homogenous cylinder shroud the diameter of which is substantially constant or may even steadily decrease so as to form a convergent cylinder shroud shape.

FIG. 4 represents an embodiment generally similar to the one shown in FIG. 3, wherein, however, the axial impeller 2 comprises only a first ring of impeller vanes 3, the first axially upwardly directed air current being generated by a separate blower 19 disposed in air exhaust duct 14 and passing through openings provided in axial impeller 2 for this purpose. In this embodiment, outer boundary surface 71 of exit opening 7 is again longer in the direction of the second air current than inner boundary surface 72.

Diagrammatically shown in FIGS. 5*a* and 5*b* is the arrangement of a baffles 16 provided for compensating the effect of a wall 17 interfering with the cylinder shroud shape of the second air current by cutting off a circle segment as shown diagrammatically at 18 in FIG. 5*b*. Without baffle 16, this disturbance would cause the cylinder shroud shape to expand or even rupture on separation from wall 17, whereby the homogeneity of the cylinder shroud shape of the second air current would be abolished. In the shown embodiment, however, the circumferential flow component of the second air current separating from wall 17 now impinges on baffle 16 extending in the axial direction along the cylinder shroud of the second air current, and is thereby deflected back to its original circumferential direction. This provision is of particular importance for a fume exhauster device employed in combination with a kitchen stove, since a stove of this kind is usually located adjacent a vertical wall, such as wall 17, likely to interfere with the cylinder shroud shape of the second air current.

FIGS. 6*a* and 6*b* show another arrangement for eliminating the disturbing effect of a wall 17. At the upper portion of the wall 17 adjacent the cylinder shroud shaped second air current, the embodiment shown provides a curved baffle 20 gradually sloping away from wall 17 in the direction of the second air current for slightly deflecting the cylinder shroud periphery at a downward inclined angle, so that the homogenous cylinder shroud shape of the second air current is not disturbed or impaired by wall 17. As shown in FIG. 6*b*, curved baffle 20 may be provided with additional baffles 16', the effect of which is similar to that of baffle 16 shown in FIGS. 5*a* and 5*b*. A plurality of such baffles 16' may be provided, in which case they are preferably graduated as to size for achieving optimum compensation of the disturbing effect of wall 17.

A further embodiment of the fume exhauster device shown in FIG. 7*a* employs neither an axial impeller nor a radial impeller rotor, instead of which it is provided with stationary deflector members 31 corresponding to the impeller vanes 3 of axial impeller 2 and located in exit opening 7. Deflector members 31 are disposed substantially radially and are formed and oriented such as to convert an air current impinging thereon from above into a second air current having a downwardly directed axial as well as a circumferential flow component. Also in this case, the outer boundary surface 71 of exit opening 7 is longer in the direction of the second air current than it inner boundary surface 72. Similar to the embodiment shown in FIG. 4, the first air current is generated or assisted by a blower 19 in air exhaust duct 14, while the second air current is generated by means of a separate blower 20 disposed in air intake duct 15 in cooperation with the above mentioned stationary deflector members 31.

A further embodiment of the fume exhauster device shown in FIG. 7*b* employs a radial impeller rotor 10 provided at its outer periphery with a filter material 43 arranged in such a manner that the axially upwardly aspirated air of the first air current is given a radial and a circumferential component, whereby this air after deflection by the stationary housing exits from exit opening 7 as the second air current having a downwardly directed axial as well as a circumferential flow component. In this embodiment, outer boundary surface 71 is again formed by the inner peripheral surface of housing 1, while inner boundary surface 72 of exit opening 7 is formed by the outer peripheral surface of the radial impeller rotor.

From the plurality of the above described embodiments it is evident that the annular exit opening 7 and the particular configuration of its outer and inner boundary surfaces 71 and 72, respectively, permit the formation of the second air current into a homogenous cylinder shroud shape of considerable length without requiring, as in prior art, a swirl duct of considerable dimensions. An important characteristic in connection with the particular configuration of the exit opening is the provision that the second air current is imparted a downwardly directed axial as well as a circumferential flow component, as per se known from prior art.

The outer boundary surface may be aerodynamically shaped as a deflector surface having for instance an airfoil profile in cross section for influencing the shape of the cylinder shroud air current, e.g. to make it convergent or divergent.

I claim:

1. A fume exhauster device comprising means for generating an air current directed substantially axially, and for directing said air current concentrically surrounding said air current directed axially and having one axial flow-component directed substantially opposite to the flowing direction of said air current directed axially and a second circulating flow-component surrounding said air current directed axially, characterized in that said means comprises a substantially annular exit opening defined at least along its outer periphery boundary by a peripheral surface extending in axial direction for forming said air current concentrically surrounding said air current directed axially into a cylindrical integral shroud, the outer diameter of which is substantially equal to the outer diameter of said exit opening.

2. The fume exhauster device according to claim 1, characterized in that the outer peripheral boundary surface defining said exit opening is longer in the direction of the concentric air current than an inner peripheral surface.

3. The fume exhauster device according to claim 1, characterized in that said means includes an axial impeller, the impeller vanes of which extend in substantially radial direction within said exit opening.

4. The fume exhauster device according to claim 3, characterized in that the outer boundary surface of said exit opening is the outer peripheral boundary surface of said axial impeller.

5. The fume exhauster device according to claim 1, wherein said means includes air flow guide means and a radial impeller rotor, the outlet side of said impeller rotor communicates with said exit opening via said airflow guide means.

6. The fume exhauster device according to claim 1, wherein said means includes an axial impeller having a first ring of impeller vanes concentrically surrounding a second ring of impeller vanes, the angle of attack of the vanes of said second ring being opposite to the angle of attack of the vanes of said first ring.

7. The fume exhauster device according to claim 1, wherein said means includes an axial impeller and a stationary housing surrounding said axial impeller, the outer boundary surface of said annular exit opening being the inner peripheral surface of said stationary housing.

8. The fume exhauster device according to claim 5, including a disc-shaped plate connected to said radial impeller rotor, a peripheral edge of said plate forming the inner boundary of said annular exit opening and said plate having a central opening for passage of said air current directed axially.

9. The fume exhauster device according to claim 8, including at least one filter disc disposed in said central opening of said plate.

10. The fume exhauster device according to claim 8 or claim 32, including a filter ring concentrically arranged to said radial impeller rotor for passage therethrough of the air current exiting from said radial impeller rotor prior to reaching said exit opening.

11. The fume exhauster device according to claim 8 or claim 9, wherein said plate has an extended peripheral surface extending in the axial direction of flow of said air current concentrically surrounding said air current directed axially beyond the outer boundary surface of said exit opening.

12. The fume exhauster device according to claim 1, wherein said means for generating an air current directed substantially axially, and for directing an air current concentrically surrounding said air current directed axially comprises a first means for generating said air current directed substantially axially and a second means for directing an air current concentrically surrounding said air current directed axially, said second means including a substantially annular exit opening defined at least along its outer periphery by a peripheral surface extending in axial direction for forming said air current concentrically surrounding said air current directed axially into a cylindrical integral shroud the outer diameter of which is substantially equal to the outer diameter of said exit opening.

13. The fume exhauster device according to claim 12, wherein said second means includes a stationary flow deflector member disposed in said exit opening and extending in substantially radial direction.

14. A fume exhauster device comprising means for generating an air current directed substantially axially, and for directing an air current concentrically surrounding said air current directed axially and having one axial flow-component directed substantially opposite to the flowing direction of said air current directed axially and a second circulating flow-component surrounding said air current directed axially, characterized in that said means comprises a substantially annular exit opening defined at least along its outer periphery by a peripheral boundary surface extending in axial direction for forming said air current concentrically surrounding said air current directed axially into a cylindrical integral shroud, the outer diameter of which is substantially equal to the outer diameter of said exit opening, all of said axially generated air current being directed into an air current concentrically surrounding said air current directed axially and said means comprises a housing defining a substantially annular exit opening.

15. A fume exhauster device comprising means for generating an air current directed substantially axially, and for directing an air current concentrically surrounding said air current directed axially and having one axial flow-component directed substantially opposite to the flowing direction of said air current directed axially and a second circulating flow-component surrounding said air current directed axially in combination with a wall causing a secant-shaped disturbance of said concentric air current, characterized in that a baffle extending substantially in the axial direction of said concentric air current is disposed on said wall in such a manner that the air flow separating from said wall in the circumferential direction of said concentric air current impinges on said baffle and is deflected thereby substantially back to the original circumferential direction, said means comprises a substantially annular exit opening defined at least along its outer periphery by a peripherical surface extending in axial direction for forming said air current concentrically surrounding said air current directed axially into a cylindrical integral shroud the outer diameter of which is substantially equal to the outer diameter of said exit opening.

16. A fume exhauster device comprising means for generating an air current directed substantially axially, and for directing an air current concentrically surrounding said air current directed axially and having one axial flow-component directed substantially opposite to the flowing direction of said air current directed axially and a second circulating flow-component surrounding said air current directed axially in combination with a wall causing a secant-shaped disturbance of said concentric air current, characterized in that said wall has associated therewith a curved baffle gradually sloping away from said wall in the axial direction of said concentric air current and operative to slightly tilt said second air current away from said wall with respect to its original axis, said means comprises a substantially annular exit opening defined at least along its outer periphery by a peripherical surface extending in axial direction for forming said air current concentrically surrounding said air current directed axially into a cylindrical integral shroud the outer diameter of which is substantially equal to the outer diameter of said exit opening.

17. The fume exhauster device according to claim 16, characterized in that at least one further baffle extending in the axial direction of said concentric air current is disposed on said curved baffle in such a manner that the airflow leaving said curved baffle in the circumferential direction of said concentric air current impinges on said further baffle and is thereby deflected substantially back to the original circumferential direction.

* * * * *